US011402791B2

(12) United States Patent
Yuasa et al.

(10) Patent No.: US 11,402,791 B2
(45) Date of Patent: Aug. 2, 2022

(54) IMAGE FORMING APPARATUS AND LUBRICANT SUPPLY CONTROL METHOD

(71) Applicant: Konica Minolta, Inc., Tokyo (JP)

(72) Inventors: Kei Yuasa, Tokyo (JP); Takenobu Kimura, Tokyo (JP); Takashi Akazawa, Tokyo (JP); Kei Okamura, Kanagawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/496,388

(22) Filed: Oct. 7, 2021

(65) Prior Publication Data

US 2022/0121149 A1 Apr. 21, 2022

(30) Foreign Application Priority Data

Oct. 21, 2020 (JP) ..... JP2020-176691

(51) Int. Cl.
*G03G 21/00* (2006.01)

(52) U.S. Cl.
CPC ..... *G03G 21/0094* (2013.01)

(58) Field of Classification Search
CPC ..... G03G 21/0094; G03G 21/0011; G03G 21/0035
USPC ..... 399/346
See application file for complete search history.

(56) References Cited

U.S. PATENT DOCUMENTS

2017/0336750 A1* 11/2017 Haga ..... G03G 15/5041
2019/0163093 A1* 5/2019 Inagaki ..... G03G 5/0507
2019/0196353 A1* 6/2019 Kodama ..... G03G 15/011

FOREIGN PATENT DOCUMENTS

JP 2012-042882 A 3/2012

* cited by examiner

*Primary Examiner* — Jessica L Eley
(74) *Attorney, Agent, or Firm* — Squire Patton Boggs (US) LLP

(57) ABSTRACT

Provided is an image forming apparatus including: a transfer member; a first image carrier on which a first toner image using toner of a first color is formed; a second image carrier which is provided on a downstream side relative to the first image carrier in a moving direction (rotating direction) of the transfer member, and on which a second toner image using toner of a second color is formed; a lubricant supply section that supplies a lubricant to the second image carrier; and a control section that controls a supply amount of the lubricant to the second image carrier in accordance with an overlap amount between the first toner image and the second toner image which are transferred from the first image carrier and the second image carrier to the transfer member.

7 Claims, 6 Drawing Sheets

IMAGE FORMING APPARATUS AND LUBRICANT SUPPLY CONTROL METHOD

CROSS REFERENCE TO RELATED APPLICATIONS

The entire disclosure of Japanese Patent Application No. 2020-176691 filed on Oct. 21, 2020 is incorporated herein by reference in its entirety.

BACKGROUND

Technological Field

The present invention relates to an image forming apparatus and a lubricant supply control method.

Description of Related Art

Generally, an image forming apparatus (e.g., printer, copier, facsimile), which employs an electrophotographic process technology, forms an electrostatic latent image by irradiating (exposing) a charged photoconductor with a laser beam based on image data. The image forming apparatus then visualizes the electrostatic latent image by supplying toner from a developing device to the photoconductor (image carrier) on which the electrostatic latent image is formed and thereby forms a toner image. In addition, when a recording medium (sheet) passes through a secondary transfer nip after the toner images on the photoconductors are sequentially superimposed and primary-transferred to an intermediate transfer member, the toner image on the intermediate transfer member is secondary-transferred to the sheet. Thus, the sheet to which the toner image is transferred is conveyed toward a fixing device, and the tone image is fixed onto the sheet in the fixing device by being heated and pressed; as a result, an image is thereby formed on the sheet.

An electrophotographic-type image forming apparatus includes a lubricant application device for coating the photoconductor with a lubricant (e.g., metallic soap) having a lubrication function for the purpose of improving cleaning performance for the photoconductor. Coating the photoconductor with the lubricant improves releasability of the toner developed on the photoconductor (that is, reduces an adhesion force with a surface of the photoconductor); as a result, transferability of a toner image and thus stability of image quality are also improved. Moreover, frictional resistance acting between the surface of the photoconductor and a cleaning member (e.g., cleaning blade) is reduced, and thus prolonging life of the cleaning member is possible.

Lubricants are generally solid, and the lubricant which has been scraped off by a coating brush roller into powdery is applied to a photoconductor. The applied lubricant is fixed to the surface of the photoconductor by a leveling blade or the like.

Moreover, some recent image forming apparatuses can use spot color toner, which is other than colored toner, in addition to the colored toner that is toner of CMYK (yellow (Y), magenta (M), cyan (C), and black (K)). Examples of the spot color toner include clear toner (such as transparent toner, colorless toner, achromatic color toner, and no pigment toner) and white (W) toner. The clear toner is supplied entirely or partly over a printed medium, on which a color image is formed, to adjust gloss and generate a high value-added print. The white (W) toner is used to reproduce an aimed color by improving color development of the color image.

Such an image forming apparatus includes one or more image forming units that form a spot color toner image using the spot color toner, in addition to the four image forming units that form the colored toner images using CMYK colored toner, respectively.

Japanese Patent Application Laid-Open No. 2012-42882 discloses a technology for suppressing occurrence of spreading of toner due to toner scattering and referred to as blur in an image that is finally obtained when black toner (colored toner) and colorless clear toner (spot color toner) are transferred so as to overlap on a transfer-receiving unit such as an intermediate transfer belt or a sheet surface. The technology described in Japanese Patent Application Laid-Open No. 2012-42882 pinpoints an area on which a transparent toner image to be superimposed within a linear image area to be formed by black toner and performs replacement processing in that at least part of black image on the pinpointed image area is formed with a hybrid of two or more kinds of colored toner instead of the black toner.

SUMMARY

However, when the spot color toner image using the spot color toner (e.g., the white (W) toner) and the colored toner image are sequentially primary-transferred to the intermediate transfer member, the amount of spot color toner reaching a coating brush roller, specifically, the amount of external additive contained in the spot color toner may increase due to overlap between the spot color toner image and the colored toner image. When the amount of external additive reaching the coating brush roller increases, the amount of lubricant scraped off by the coating brush roller increases, and thus, the amount of lubricant applied to the photoconductor by the coating brush roller (lubricant consumption) also increases. When the lubricant is exhausted as a result of an increase in the lubricant consumption, an appropriate amount of lubricant cannot be applied to the photoconductor. Consequently, continuous usage in this state leads to wearing out of a cleaning member and thus deterioration of cleaning performance, which causes deterioration of an output image in the image quality. Thus, it is necessary to replace the lubricant or a developing unit having a lubricant with a new unit before the lubricant is exhausted. Hereinafter, a description will be given with specific examples.

For example, in a moving direction of the intermediate transfer member, when image forming unit that forms the colored toner image (downstream side image forming unit) is placed on a downstream side relative to an image forming unit that forms the spot color toner image (upstream side image forming unit), the spot color toner image which does not overlap with the colored toner image on the intermediate transfer member (i.e., the spot color toner image on which the colored toner image is not transferred) is reversely transferred to the photoconductor of the downstream side image forming unit. As a result, in the downstream image forming unit, the amount of spot color toner, that is, external additive reaching the coating brush roller increases, and thus, the amount of lubricant scraped off by the coating brush roller, that is, the lubricant consumption increases.

Note that, the spot color toner image which overlaps with the colored toner image on the intermediate transfer member is not reversely transferred to the photoconductor of the downstream side image forming unit. As a result, in the downstream image forming unit, the amount of spot color toner, that is, external additive reaching the coating brush roller does not increase, and thus, the amount of lubricant scraped off by the coating brush roller and the lubricant consumption also does not increase.

On the other hand, in the moving direction of the intermediate transfer member, when image forming unit that forms the colored toner image (upstream side image forming unit) is placed on an upstream side relative to an image forming unit that forms the spot color toner image (downstream side image forming unit), transferability (transfer rate) of the spot color toner image which overlaps with the colored toner image on the intermediate transfer member (i.e., the spot color toner image which is transferred onto the colored toner image) decreases. As a result, in the downstream image forming unit, the amount of spot color toner, that is, external additive reaching the coating brush roller without being transferred increases, and thus, the amount of lubricant scraped off by the coating brush roller, that is, the lubricant consumption increases.

Note that, transferability (transfer rate) of the spot color toner image which does not overlap with the colored toner image on the intermediate transfer member (i.e., the spot color toner image which is not transferred onto the colored toner image) does not decrease. As a result, in the downstream image forming unit, the amount of spot color toner reaching the coating brush roller, that is, external additive does not increase; thus, the amount of lubricant scraped off by the coating brush roller, that is, the lubricant consumption also does not increase.

An object of the present invention is to provide an image forming apparatus and a lubricant supply control method capable of suppressing an increase in lubricant consumption.

To achieve at least one of the abovementioned objects, according to an aspect of the present invention, an image forming apparatus reflecting one aspect of the present invention includes:

a transfer body;

a first image carrier on which a first toner image using toner of a first color is formed;

a second image carrier on which a second toner image using toner of a second color is formed, the second image carrier being provided on a downstream side relative to the first image carrier in a moving direction of the transfer body;

a lubricant supplier that supplies a lubricant to the second image carrier; and a hardware processor that controls a supply amount of the lubricant in accordance with an overlap amount between the first toner image and the second toner image which are transferred from the first image carrier and the second image carrier to the transfer body.

To achieve at least one of the abovementioned objects, according to another aspect of the present invention, a lubricant supply control method reflecting one aspect of the present invention is for an image forming apparatus including: a transfer body; a first image carrier on which a first toner image using toner of a first color is formed; and a second image carrier on which a second toner image using toner of a second color is formed, the second image carrier being provided on a downstream side relative to the first image carrier in a moving direction of the transfer body, the lubricant supply control method including:

controlling a supply amount of a lubricant to the second image carrier in accordance with an overlap amount between the first toner image and the second toner image which are transferred from the first image carrier and the second image carrier to the transfer body.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Hereinafter, an embodiment of the present invention will be described in detail with reference to the accompanying drawings.

Figure 1:
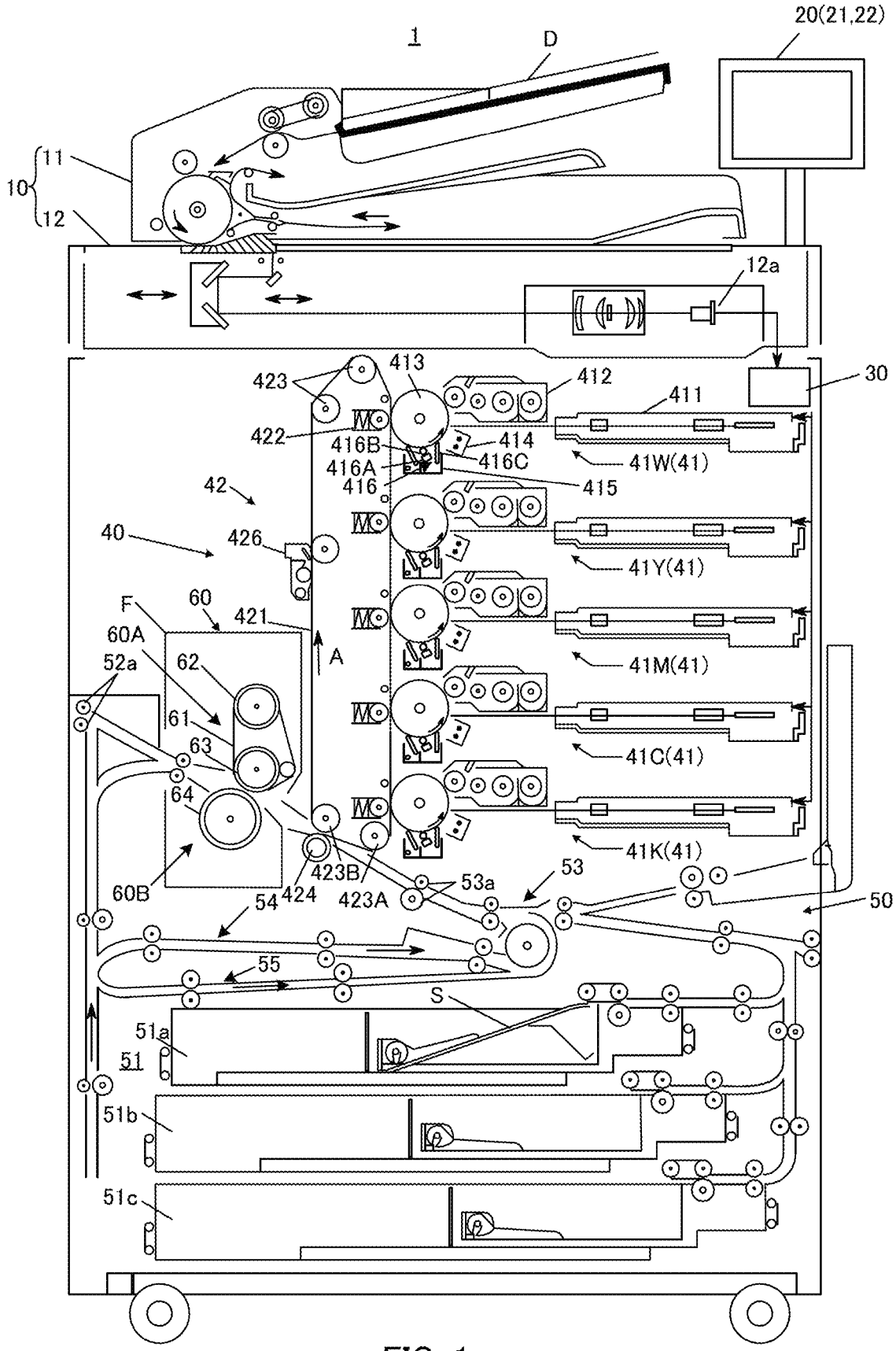
FIG. 1 schematically illustrates an entire configuration of an image forming apparatus according to the present embodiment.
Figure 2:
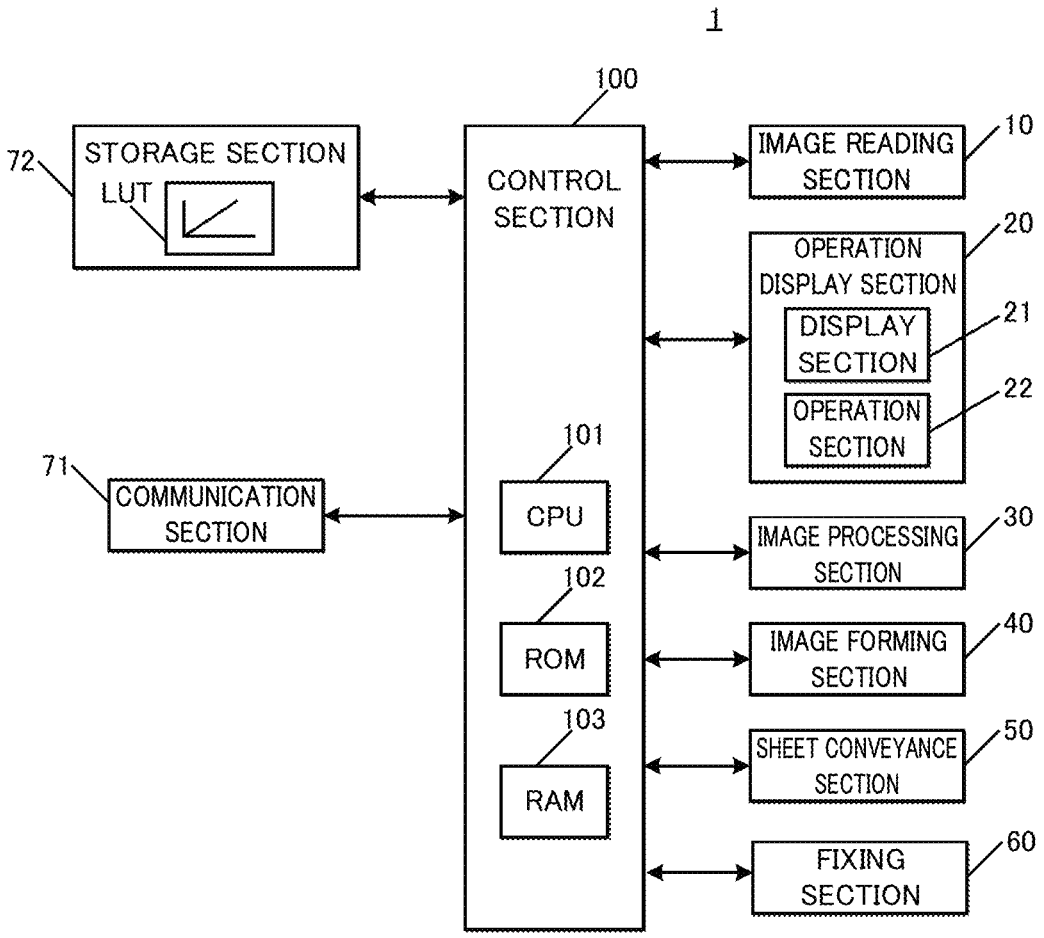
FIG. 2 illustrates main sections of a control system of the image forming apparatus according to the present embodiment.

FIG. 1 schematically illustrates an entire configuration of image forming apparatus 1 according to the present embodiment. FIG. 2 illustrates main sections of a control system of image forming apparatus 1 according to the present embodiment.

As illustrated in FIGS. 1 and 2, image forming apparatus 1 is a color image forming apparatus of an intermediate transfer system type utilizing electrophotographic process technology. That is, image forming apparatus 1 primary-transfers toner images of respective colors of white (W), cyan (C), magenta (M), yellow (Y), and black (K), which are formed on photoconductor drums 413, to intermediate transfer belt 421 (corresponding to a "transfer member" of the present invention) and then secondary-transfers the toner images to sheet S to thereby form an image.

Image forming apparatus 1 adopts a tandem method in which photoconductor drums 413 corresponding to the five colors of WCMYK are aligned in series in the moving direction of intermediate transfer belt 421 and the toner images of the respective colors are sequentially transferred onto intermediate transfer belt 421 through one procedure.

In the present embodiment, toner of four colors (also referred to as colored or standard color) of yellow (Y), magenta (M), cyan (C), and black (K) (corresponding to "toner of the second color" of the present invention) is used as toner for forming a color image based on an input image data (input image information) (hereinafter, also referred to as a colored toner image, corresponding to a "second toner image" of the present invention) on a sheet through intermediate transfer belt 421. On the other hand, toner of white (W), that is, toner of a spot color (corresponding to "toner of the first color" of the present invention) is used as toner for forming a white image (hereinafter, also referred to as a spot color toner image, corresponding to a "first toner image" of the present invention) under the color image on sheet S from the viewpoint of reproducing the intended color by improving color development of the color image. Incidentally, the spot color toner has features such as a low degree of circularity, a large particle size, and a heavy specific gravity as compared with the colored toner, depending on an additive held for the purpose other than improving the color reproducibility of the color image. Moreover, the spot color toner may be clear toner instead of white (W) toner.

As illustrated in FIGS. 1 and 2, image forming apparatus 1 includes image reading section 10, operation display section 20, image processing section 30, image forming section 40, sheet conveyance section 50, fixing section 60 and control section 100.

Control section 100 includes Central Processing Unit (CPU) 101, Read Only Memory (ROM) 102, Random Access Memory (RAM) 103, and the like. CPU 101 reads a program corresponding to processing contents from ROM 102 and loads the program into RAM 103 (volatile memory), and controls operation of each block of image forming apparatus 1 in a centralized manner in cooperation with the loaded program. At this time, various kinds of data such as a Look Up Table (LUT) stored in storage section 72 are referred to.

Control section 100 transmits and receives the various kinds of data to and from an external device (e.g., a personal computer) connected to a communication network such as a Local Area Network (LAN) or a Wide Area Network (WAN) via communication section 71. For example, control section 100 receives input image data transmitted from the external device and forms an image on a sheet on the basis of the input image data. Communication section 71 is configured of, for example, a communication control card such as a LAN card.

Image reading section 10 is configured to include automatic document feeding device 11 also called as an Auto Document Feeder (ADF), document image scanning device 12 (scanner), and the like.

Automatic document feeding device 11 conveys document D placed on a document tray by a conveying mechanism and sends out document D to document image scanning device 12. Automatic document feeding device 11 can continuously read at once images (including those on both sides) of a large number of documents D placed on the document tray.

Document image scanning device 12 optically scans document D conveyed from automatic document feeding device 11 onto a contact glass or document D placed on the contact glass, forms an image of light reflected from document D on a light receiving surface of Charge Coupled Device (CCD) sensor 12*a*, and thereby reads a document image. Image reading section 10 generates the input image data based on a result of the reading provided by document image scanning device 12. On the input image data, predetermined image processing is performed in image processing section 30.

Operation display section 20 is configured of, for example, a Liquid Crystal Display (LCD) with a touch-screen, and functions as display section 21 and operation section 22. Display section 21 displays various operation screens, operation conditions of each function, and the like in accordance with display control signals input from control section 100. Operation section 22 includes various operation keys such as a numeric key and a start key, receives various input operations performed by a user, and outputs operation signals to control section 100.

Image processing section 30 includes a circuit or the like for performing a digital image process on the input image data, according to an initial setting or a user setting. In one example, image processing section 30 performs tone correction based on tone correction data (tone correction table) under the control of control section 100. Moreover, image processing section 30 performs, on the input image data, various correction processes such as color correction and shading correction, as well as compression processing, in addition to the tone correction. Image forming section 40 is controlled based on the image data on which these processes have been performed.

Image forming section 40 includes, for example: image forming units 41Y, 41M, 41C, and 41K for forming a color image by colored toner of a Y component, an M component, a C component, and a K component; image forming unit 41W for forming a white image by the white toner of a W component, on the basis of the input image data; and intermediate transfer unit 42.

Image forming units 41Y, 41M, 41C, 41K, and 41W for the respective components of Y, M, C, K and W have similar configurations. For convenience of illustration and description, common constituent elements are denoted by the same reference signs, and the reference signs are illustrated with Y, M, C, K, or W in a case where constituent elements are distinguished from one another. In FIG. 1, only constituent element of image forming unit 41W for the W component is denoted by the reference sign, and reference signs are omitted for the constituent elements of the other image forming units 41Y, 41M, 41C, and 41K.

Image forming unit 41 includes exposure device 411, developing device 412, photoconductor drum 413, charging device 414, and drum cleaning device 415. Note that, photoconductor drum 413 included in image forming unit 41W corresponds to a "first image carrier" of the present invention. Meanwhile, photoconductor drums 413 included in image forming units 41Y, 41M, 41C and 41K correspond to a "second image carrier" of the present invention.

Photoconductor drum 413 is a photoconductor having photoconductivity formed by sequentially laminating an under coat layer (UCL), a charge generation layer (CGL), and a charge transport layer (CTL) on the peripheral surface of a conductive cylindrical body made of aluminum (an aluminum element tube), for example. Photoconductor drum 413 is, for example, a negative charge type organic photoconductor (OPC).

Charging device 414 is a scorotron charger that uniformly negatively charges the surface of photoconductor drum 413 having photoconductivity.

Exposing device 411 is formed of, for example, a semiconductor laser, and irradiates photoconductor drum 413 with laser light corresponding to the image of each color component. Irradiation by the laser light generates a positive charge in the charge generation layer of photoconductor drum 413, and the positive charge is transported to a surface of the charge transport layer, whereby the surface charge (negative charge) of photoconductor drum 413 is neutralized. As a result, on the surface of photoconductor drum 413, an electrostatic latent image of each color component is formed by a potential difference from the surroundings.

Developing device 412 houses a developer of each color component (e.g., a two-component developer composed of toner with a small particle size and a carrier (magnetic substance)), forms a toner image by attaching toner of each color component to the surface of photoconductor drum 413 to visualize the electrostatic latent image.

Drum cleaning device 415 includes a drum cleaning blade that is brought into slide-contact with the surface of photoconductor drum 413 and lubricant application device 416.

Transfer residual toner, which remains on the surface of photoconductor drum 413 after the primary transfer, is scraped off and removed by the drum cleaning blade. Note that, lubricant application devices 416 included in image forming units 41Y, 41M, 41C, and 41K correspond to the "lubricant supply section" of the present invention.

Lubricant application device 416 is positioned on a downstream side relative to the drum cleaning blade in a rotating direction of photoconductor drum 413 and supplies a lubricant by applying it to the surface of photoconductor drum 413. Lubricant application devices 416 are provided corresponding respectively to photoconductor drums 413 and each include solid lubricant 416A (corresponding to a "lubricant" of the present invention), coating brush roller 416B (corresponding to a "rotation brush" of the present invention), a spring (not illustrated), and leveling blade 416C.

Solid lubricant 416A is a lubricant formed into a rectangular parallelepiped shape and is pressed toward coating brush roller 416B by the spring.

Coating brush roller 416B is rotatably placed between solid lubricant 416A and photoconductor drum 413 and is in contact with each of solid lubricant 416A and photoconductor drum 413 Coating brush roller 416B, under the control of control section 100, scrapes off a lubricant from solid lubricant 416A, then transfers the scraped off lubricant to a contact position with photoconductor drum 413, and thereby supplies the lubricant to photoconductor drum 413. Thus, the amount (coated amount) of lubricant to be supplied (hereinafter may be referred to as the "supply amount of lubricant") is controlled by the rotational speed of coating brush roller 416B.

Leveling blade 416C is a rubber-like leveling blade and is placed on a downstream side relative to solid lubricant 416A and coating brush roller 416B in the rotating direction of photoconductor drum 413. Leveling blade 416C is formed to press the lubricant supplied onto photoconductor drum 413 against photoconductor drum 413. Pressing the lubricant against this leveling blade 416C allows equalization of the lubricant amount on photoconductor drum 413.

Intermediate transfer unit 42 includes intermediate transfer belt 421, primary transfer roller 422, a plurality of support rollers 423, secondary transfer roller 424, and belt cleaning apparatus 426 and the like.

Intermediate transfer belt 421 is made up of an endless belt, and is suspended in a tensioned state like a loop around a plurality of support rollers 423. At least one of support rollers 423 is formed of a driving roller, and the others are each formed of a driven roller. For example, roller 423A placed on a downstream side in the belt moving direction relative to primary transfer roller 422 for the K component is preferably a driving roller. Thereby, the traveling speed of the belt in the primary transfer section is easily maintained at a constant speed. When driving roller 423A rotates, intermediate transfer belt 421 travels in arrow A direction at a constant speed.

Intermediate transfer belt 421 is rotationally driven by a control signal from control section 100.

Primary transfer rollers 422 are arranged on an inner peripheral side of intermediate transfer belt 421 to face photoconductor drums 413 of the respective color components. Primary transfer rollers 422 are brought into pressure-contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is placed to face backup roller 423B disposed on a downstream side in the belt moving direction relative to driving roller 423A, at a position on an outer peripheral surface of intermediate transfer belt 421. Secondary transfer roller 424 is brought into pressure-contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are primary-transferred to intermediate transfer belt 421 sequentially in a superimposed manner. Specifically, a primary transfer bias is applied to primary transfer rollers 422, and a charge of the polarity opposite to that of the toner is applied to the rear surface side of intermediate transfer belt 421, that is, the side abutting on primary transfer rollers 422, whereby the toner image is electrostatically transferred to intermediate transfer belt 421.

Then, when sheet S passes through the secondary transfer nip, the toner image on intermediate transfer belt 421 is secondary-transferred to sheet S. Specifically, a secondary transfer bias is applied to secondary transfer roller 424, and a charge of the polarity opposite to that of the toner is applied to the rear surface side of sheet S, that is, the side abutting on secondary transfer roller 424, whereby the toner image is electrostatically transferred to sheet S. Sheet S on which the toner image has been transferred is conveyed toward fixing section 60.

Belt cleaning device 426 removes transfer residual toner remaining on the surface of intermediate transfer belt 421 after the secondary transfer.

Fixing section 60 includes upper fixing section 60A including a fixing surface side member placed on a fixing surface side of sheet S, that is, the surface on which a toner image is formed, lower fixing section 60B including a rear surface side supporting member placed on the rear surface side of sheet S, that is, the surface opposite to the fixing surface, a heating source, and the like. The rear surface side supporting member is brought into pressure-contact with the fixing surface side member, whereby a fixing nip for conveying sheet S in a tightly holding manner is formed.

At the fixing nip, fixing section 60 heats and pressurizes conveyed sheet S on which the toner image has been secondary-transferred, to thereby fix the toner image to sheet S. Fixing section 60 is placed as a unit in fixing device F.

Upper fixing section 60A includes fixing belt 61 that is the fixing surface side member and is endless, heating roller 62, and fixing roller 63. Fixing belt 61 is suspended in a tensioned state by heating roller 62 and fixing roller 63.

Fixing belt 61 comes into contact with sheet S on which the toner image is formed to heat this sheet S at a fixable temperature (e.g., 160 to 200° C.). Here, the fixable temperature refers to a temperature at which the amount of heat required to melt the toner on sheet S can be supplied, and varies depending on the type of sheet and the basis weight of sheet S subject to image formation.

Heating roller 62 incorporates therein a halogen heater as a heating source that heats fixing belt 61 and fixing roller 63.

Lower fixing section 60B includes pressure roller 64 that is the rear surface side supporting member. Pressure roller 64 pressurizes fixing roller 63 with a predetermined fixing load (e.g., 2200 N) via fixing belt 61. In this manner, pressure roller 64 forms, in between with fixing roller 63, a fixing nip for conveying sheet S in a tightly holding manner via fixing belt 61.

Pressure roller 64 is brought into pressure-contact with fixing roller 63 by the pressing means (not illustrated) via fixing belt 61 when sheet S passes through the fixing nip (at the time of sheet passing) whereas being spaced apart from fixing roller 63 when sheet S does not pass through the fixing nip (at the time of no sheet passing). Driving control of pressure roller 64 (e.g., turning the rotation on/off, and the number of rotations) is executed by control section 100.

Sheet conveyance section 50 includes sheet feeding section 51, a sheet ejecting section, conveyance path 53, and the like. In three sheet feeding tray units 51*a* to 51*c* constituting sheet feeding section 51, sheets S identified based on the basis weight, the size, and the like (standard sheet, special sheet) are stored for each type set in advance.

Sheets S stored in sheet feeding tray units 51*a* to 51*c* are sent out one by one from the uppermost part, and conveyed to image forming section 40 by a conveyance mechanism including a plurality of conveyance rollers such as registration rollers 53*a*. At this time, a registration section in which registration rollers 53*a* are arranged corrects the inclination of fed sheet S and adjusts a conveyance timing. Then, in image forming section 40, the toner image on intermediate transfer belt 421 is transferred to one surface of sheet S, and a fixing process is performed in fixing section 60. Sheet S on which the toner image is fixed by the fixing process is ejected to the outside of image forming apparatus 1 by the sheet ejection section including sheet ejection rollers 52*a*.

Sheet conveyance section 50 also includes reverse conveyance path 54 and a non-reverse conveyance path 55. Reverse conveyance path 54 is a conveyance path for reversing the front and rear of sheet S on which images (toner images) are fixed by fixing section 60 and conveying it to image forming section 40. Non-reverse conveyance path 55 is a conveyance path for conveying sheet S on which images (toner images) are fixed by fixing section 60 to image forming section 40 without reversing the front and rear of sheet S.

As described above, image forming apparatus 1 includes one image forming unit 41W that form the spot color toner image using the spot color toner, in addition to four image forming units 41Y, 41M, 41C, and 41K that form the colored toner images using CMYK colored toner.

Incidentally, when the spot color toner image and the colored toner images are sequentially primary-transferred to intermediate transfer belt 421, the amount of spot color toner reaching coating brush roller 416B, specifically, the amount of external additive contained in the spot color toner may increase due to overlap between the spot color toner image and the color toner images. When the amount of external additive reaching coating brush roller 416B increases, the amount of lubricant scraped off from solid lubricant 416A by coating brush roller 416B increases; thus, the amount of lubricant applied to photoconductor drum 413 by coating brush roller 416B (lubricant consumption) also increases. When the lubricant consumption is excessive, frictional resistance acting between the surface of photoconductor drum 413 and the cleaning member (drum cleaning blade) increases, and thus, the life of the cleaning member decreases.

A specific description will be given of a case where, as in the present embodiment, in a moving direction (rotating direction) of intermediate transfer belt 421, image forming units 41Y, 41M, 41C, and 41K that form the colored toner images (downstream side image forming units) are arranged on a downstream side relative to image forming unit 41W that forms the spot color toner image (upstream side image forming unit). In this case, the spot color toner image which does not overlap with the colored toner images on intermediate transfer belt 421 is reversely transferred to photoconductor drums 413 of image forming units 41Y, 41M, 41C, and 41K. As a result, in image forming units 41Y, 41M, 41C, and 41K, the amount of spot color toner, that is, external additive reaching coating brush roller 416B increases; thus, the amount of lubricant scraped off from solid lubricant 416A by coating brush roller 416B, that is, the lubricant consumption increases.

Note that, the spot color toner image which overlaps with the colored toner images on the intermediate transfer belt 421 is not reversely transferred to photoconductor drums 413 of image forming units 41Y, 41M, 41C, and 41K. As a result, in image forming units 41Y, 41M, 41C, and 41K, the amount of spot color toner, that is, external additive reaching coating brush roller 416B does not increase; thus, the amount of lubricant scraped off by coating brush roller 416B, that is, the lubricant consumption also does not increase.

Thus, in the present embodiment, for the purpose of suppressing a decrease in the life of the cleaning member (drum cleaning blade) by suppressing an increase in the lubricant consumption, control section 100 controls the supply amount of lubricant to photoconductor drums 413 of image forming units 41Y, 41M, 41C, and 41K in accordance with the overlap amount between the spot color toner image transferred from photoconductor drum 413 of image forming unit 41W to intermediate transfer belt 421 and the colored toner images transferred from photoconductor drums 413 of image forming units 41Y, 41M, 41C and 41K to intermediate transfer belt 421.

Figure 3:
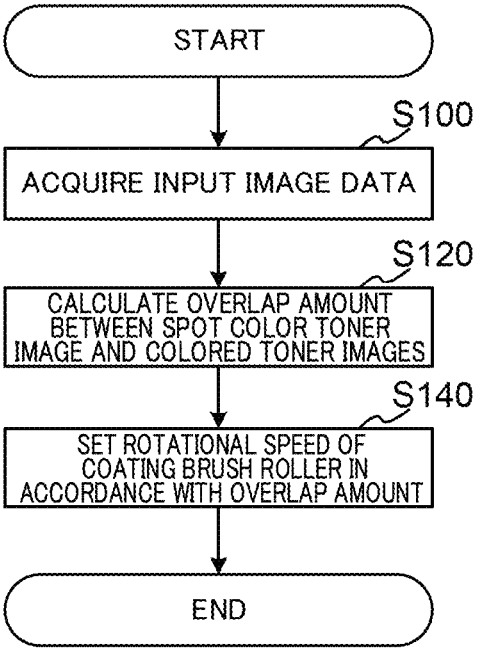
FIG. 3 is a flowchart illustrating an exemplary lubricant supply control operation according to the present embodiment.

Next, with reference to the flowchart of FIG. 3, an exemplary lubricant supply control operation of image forming apparatus 1 (corresponding to a "lubricant supply control method" of the present invention) will be described. Incidentally, the processes illustrated in FIG. 3 are performed, for example, every time an input image data transmitted from an external device is received by image forming apparatus 1.

First, control section 100 acquires an input image data transmitted from an external device (step S100).

Next, control section 100 calculates an overlap amount between the spot color image transferred from photoconductor drum 413 of image forming unit 41W to intermediate transfer belt 421 and the colored toner images transferred from photoconductor drums 413 of image forming units 41Y, 41M, 41C and 41K to intermediate transfer belt 421, based on the input image data acquired in step S100 (step S120).

Figure 4A:
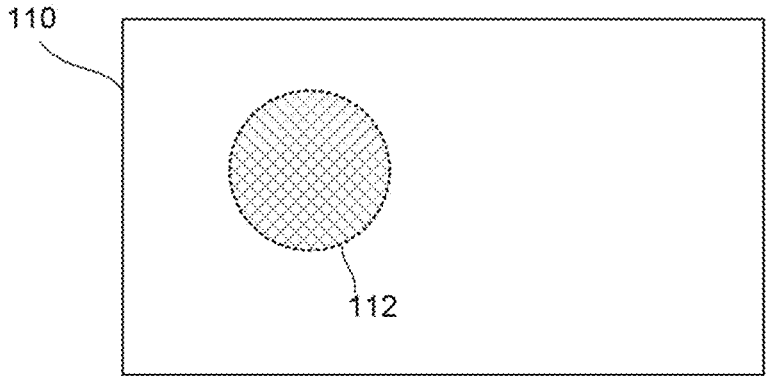
FIGS. 4A, 4B, 4C, and 4D are diagrams for describing the overlap amount between a spot color toner image and a colored toner image.
Figure 4B:
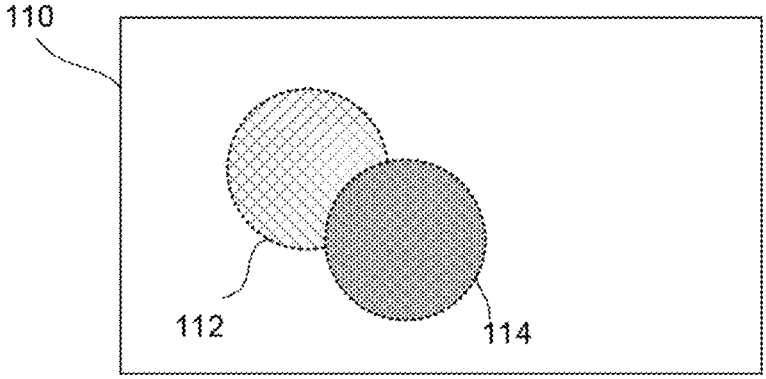
Figure 4C:
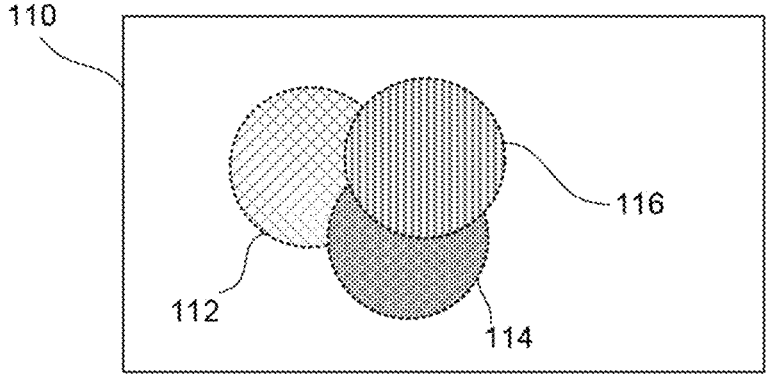

FIGS. 4A, 4B, 4C, and 4C are diagrams for describing the overlap amount between the spot color toner image and the colored toner images. FIG. 4A illustrates a state of overlap between spot color toner image 110 transferred from photoconductor drum 413 of image forming unit 41W to intermediate transfer belt 421 and colored toner image 112 transferred from photoconductor drum 413 of image forming unit 41Y to intermediate transfer belt 421. Control section 100 calculates a ratio (%) of an area of colored toner image 112 with respect to an area of spot color toner image 110 as overlap amount Y between spot color toner image 110 and colored toner image 112 on intermediate transfer belt 421.

As overlap amount Y thus calculated decreases, the area of spot color toner image 110 that is reversely transferred to photoconductor drum 413 of image forming unit 41Y increases. Consequently, in image forming unit 41Y, the amount of spot color toner, that is, external additive reaching coating brush roller 416B increases, and thus, the amount of lubricant scraped off from solid lubricant 416A by coating brush roller 416B, that is, the lubricant consumption increases.

FIG. 4B illustrates a state of overlap between spot color toner image 110 transferred from photoconductor drum 413 of image forming unit 41W to intermediate transfer belt 421 and colored toner images 112 and 114 transferred from photoconductor drums 413 of image forming units 41Y and 41M to intermediate transfer belt 421. Control section 100 calculates a ratio (%) of areas of colored toner images 112 and 114 (except for the area of the overlapping part between colored toner images 112 and 114) with respect to an area of spot color toner image 110 as overlap amount M between spot color toner image 110 and colored toner images 112 and 114 on intermediate transfer belt 421.

As overlap amount M thus calculated decreases, the area of spot color toner image 110 that is reversely transferred to photoconductor drum 413 of image forming unit 41M increases. Consequently, in image forming unit 41M, the amount of spot color toner, that is, external additive reaching coating brush roller 416B increases, and thus, the amount of lubricant scraped off from solid lubricant 416A by coating brush roller 416B, that is, the lubricant consumption increases.

FIG. 4C illustrates a state of overlap between spot color toner image 110 transferred from photoconductor drum 413 of image forming unit 41W to intermediate transfer belt 421 and colored toner images 112, 114, and 116 transferred from photoconductor drums 413 of image forming units 41Y, 41M, and 41C to intermediate transfer belt 421. Control section 100 calculates a ratio (%) of areas of colored toner images 112, 114, and 116 (except for the area of the overlapping part between colored toner images 112, 114, and 116) with respect to an area of spot color toner image 110 as overlap amount C between spot color toner image 110 and colored toner images 112, 114, and 116 on intermediate transfer belt 421.

As overlap amount C thus calculated decreases, the area of spot color toner image 110 that is reversely transferred to photoconductor drum 413 of image forming unit 41C increases. Consequently, in image forming unit 41C, the amount of spot color toner, that is, external additive reaching coating brush roller 416B increases, and thus, the amount of lubricant scraped off from solid lubricant 416A by coating brush roller 416B, that is, the lubricant consumption increases.

Figure 4D:
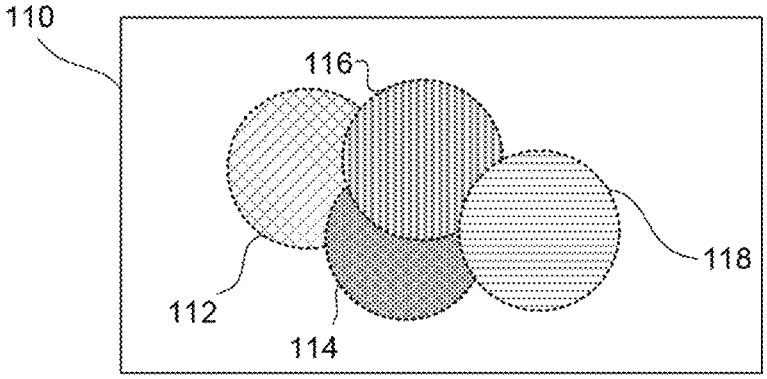

FIG. 4D illustrates a state of overlap between spot color toner image 110 transferred from photoconductor drum 413 of image forming unit 41W to intermediate transfer belt 421 and colored toner images 112, 114, 116, and 118 transferred from photoconductor drums 413 of image forming units 41Y, 41M, 41C, and 41K to intermediate transfer belt 421. Control section 100 calculates a ratio (%) of areas of colored toner images 112, 114, 116, and 118 (except for the area of the overlapping part between colored toner images 112, 114, 116, and 118) with respect to an area of spot color toner image 110 as overlap amount K between spot color toner image 110 and colored toner images 112, 114, 116, and 118 on intermediate transfer belt 421.

As overlap amount K thus calculated decreases, the area of spot color toner image 110 that is reversely transferred to photoconductor drum 413 of image forming unit 41K increases. Consequently, in image forming unit 41K, the amount of spot color toner, that is, external additive reaching coating brush roller 416B increases, and thus, the amount of lubricant scraped off from solid lubricant 416A by coating brush roller 416B, that is, the lubricant consumption increases.

Returning to the flowchart of FIG. 3, control section 100 sets the supply amount of lubricant by setting the rotational speed of coating brush roller 416B (the number of rotations per unit time) in accordance with the overlap amount calculated for each of image forming units 41Y, 41M, 41C and 41K (step S140). When the process of step S140 is completed, image forming apparatus 1 ends the processes illustrated in FIG. 3.

In the present embodiment, in a case where overlap amount Y thus calculated in step S120 is represented by A (=100−a) [%], control section 100 sets the rotational speed of coating brush roller 416B included in image forming unit 41Y, using the following Equation 1.

$$\text{Rotational speed of coating brush roller } \mathbf{416}\text{B} = \text{rotational speed of coating brush roller } \mathbf{416}\text{B (default value)} \times (1 - 0.01 \times a) \quad \text{(Equation 1)}$$

That is, taking into account that the amount of external additive reaching coating brush roller 416B increases and the amount of lubricant scraped off by coating brush roller 416B, that is, the lubricant consumption increases as overlap amount Y decreases, the rotational speed of coating brush roller 416B is made smaller than the default value in advance to reduce the supply amount (consumption) of the lubricant solely resulting from the rotation of coating brush roller 416B. Thus, it is possible to suppress an increase in lubricant consumption in image forming unit 41Y.

In addition, in a case where overlap amount M thus calculated in step S120 is represented by A (=100−a) [%], control section 100 sets the rotational speed of coating brush roller 416B included in image forming unit 41M, using the following Equation 2.

$$\text{Rotational speed of coating brush roller } \mathbf{416}\text{B} = \text{rotational speed of coating brush roller } \mathbf{416}\text{B (default value)} \times (1 - 0.01 \times a) \quad \text{(Equation 2)}$$

That is, taking into account that the amount of external additive reaching coating brush roller 416B increases and the amount of lubricant scraped off by coating brush roller 416B, that is, the lubricant consumption increases as overlap amount M decreases, the rotational speed of coating brush roller 416B is made smaller than the default value in advance to reduce the supply amount (consumption) of the lubricant solely resulting from the rotation of coating brush roller 416B. Thus, it is possible to suppress an increase in lubricant consumption in image forming unit 41M.

In addition, in a case where overlap amount C thus calculated in step S120 is represented by A (=100−a) [%], control section 100 sets the rotational speed of coating brush roller 416B included in image forming unit 41C, using the following Equation 3.

$$\text{Rotational speed of coating brush roller } \mathbf{416}\text{B} = \text{rotational speed of coating brush roller } \mathbf{416}\text{B (default value)} \times (1 - 0.01 \times a) \quad \text{(Equation 3)}$$

That is, taking into account that the amount of external additive reaching coating brush roller 416B increases and the amount of lubricant scraped off by coating brush roller 416B, that is, the lubricant consumption increases as overlap amount C decreases, the rotational speed of coating brush roller 416B is made smaller than the default value in advance to reduce the supply amount (consumption) of the lubricant solely resulting from the rotation of coating brush roller 416B. Thus, it is possible to suppress an increase in lubricant consumption in image forming unit 41C.

In addition, in a case where overlap amount K thus calculated in step S120 is represented by A (=100−a) [%], control section 100 sets the rotational speed of coating brush roller 416B included in image forming unit 41 K, using the following Equation 4.

Rotational speed of coating brush roller 416B=rotational speed of coating brush roller 416B (default value)×(1−0.01×*a*) (Equation 4)

That is, taking into account that the amount of external additive reaching coating brush roller 416B increases and the amount of lubricant scraped off by coating brush roller 416B, that is, the lubricant consumption increases as overlap amount K decreases, the rotational speed of coating brush roller 416B is made smaller than the default value in advance to reduce the supply amount (consumption) of the lubricant solely resulting from the rotation of coating brush roller 416B. Thus, it is possible to suppress an increase in lubricant consumption in image forming unit 41K.

Figure 5:
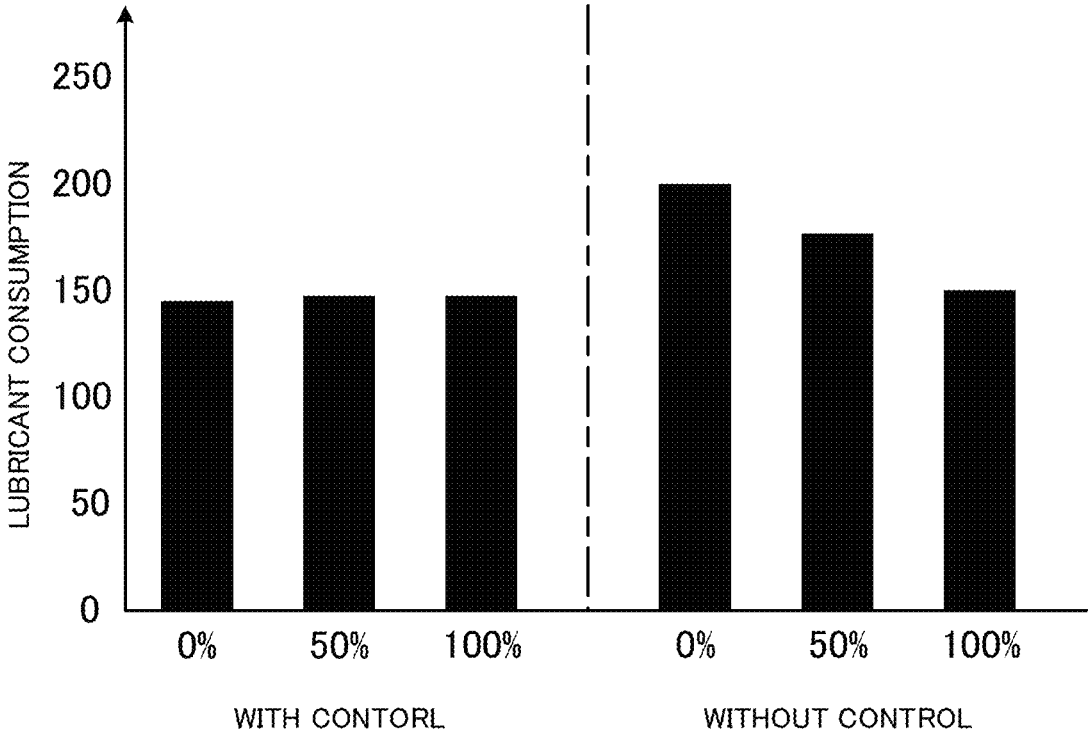
FIG. 5 illustrates a relationship between the overlap amount between the spot color toner image and the colored toner images, and lubricant consumption.

FIG. 5 illustrates a relationship between the overlap amount between the spot color toner image and the colored toner images, and lubricant consumption in image forming units 41Y, 41M, 41C, and 41K. Specifically, FIG. 5 illustrates an experimental result of how the lubricant consumption varies between when the lubricant supply control operation illustrated in FIG. 3 is executed (with control) and when the lubricant supply control operation is not executed (without control), in a case where two type charts, namely, a spot color chart and a colored chart are prepared to form an image and the overlap amounts between the spot color toner image and the colored toner images are set to 0 [%], 50 [%], and 100 [%], respectively.

As illustrated in FIG. 5, when the lubricant supply control operation is not executed, the lubricant consumption may increase as the overlap amount between the spot color toner image and the colored toner images decreases (approaches 0%). On the other hand, when the lubricant feed control operation is executed, the lubricant consumption is stable and does not increase as the overlap amount between the spot toner image and the colored toner images decreases. Thus, it is possible to suppress an increase in lubricant consumption in image forming units 41Y, 41M, 41C, and 41K. As a result, in the case of a replaceable image forming unit integrally provided with a lubricant, it is possible to suppress a decrease in the life of each of the image forming unites.

As described in detail above, in the present embodiment, image forming apparatus 1 includes: a transfer member (intermediate transfer belt 421); a first image carrier (photoconductor drum 413 of image forming unit 41W) on which a first toner image (spot toner image) using toner of a first (spot) color is formed; a second image carrier (photoconductor drums 413 of image forming units 41Y, 41M, 41C, and 41K) which is provided on a downstream side relative to the first image carrier in a moving direction (rotating direction) of the transfer member, and on which a second toner image (colored toner image) using toner of a second (colored) color is formed; a lubricant supply section (lubricant application device 416) that supplies a lubricant to the second image carrier; and control section 100 that controls a supply amount of lubricant to the second image carrier in accordance with an overlap amount between the first toner image and the second toner image which are transferred from the first image carrier and the second image carrier to the transfer member. Specifically, control section 100 reduces the supply amount of lubricant as the overlap amount between the first toner image and the second toner image which are transferred from the first image carrier and the second image carrier to the transfer member decreases.

According to the present embodiment configured as described above, taking into account that the amount of external additive reaching coating brush rollers 416B of image forming units 41Y, 41M, 41C, and 41K increases and the amount of lubricant scraped off by coating brush roller 416B, that is, the lubricant consumption increases as the overlap amount between the spot toner image and the colored toner images on intermediate transfer belt 421 decreases, the supply amount of lubricant is thus controlled to be smaller. As a result, it is possible to suppress an increase in lubricant consumption in image forming units 41Y, 41M, 41C, and 41K.

In the above embodiment, a description has been given with an example of adopting, for image forming apparatus 1, a tandem method in which photoconductor drums 413 corresponding to the five colors of WCMYK are aligned in series in the moving direction of intermediate transfer belt 421 and the toner images of the respective colors are sequentially transferred onto intermediate transfer belt 421 through one procedure; however, the present invention is not limited to this. For example, for image forming apparatus 1, a tandem method may adopted in which photoconductor drums 413 corresponding to six or more colors including WCMYK are aligned in series in the moving direction of intermediate transfer belt 421 and the toner images of the respective colors are sequentially transferred onto intermediate transfer belt 421 through one procedure.

In addition, in the above embodiment, a description has been given with an example in which the supply amount of lubricant to photoconductor drum 413 is controlled by controlling the rotational speed of coating brush roller 416B; however, the present invention is not limited to this. For example, the supply amount of lubricant to photoconductor drum 413 may be controlled by controlling a pressing force of solid lubricant 416A against coating brush roller 416B. In this case, control section 100 reduces the supply amount of lubricant to photoconductor drum 413 by reducing the pressing force of solid lubricant 416A against coating brush roller 416B.

Moreover, in the above embodiment, from the viewpoint of more effectively suppressing a decrease in the life of the lubricant, the rotational speed of a developing sleeve of developing device 412, that is, conveyance speed of the developer may be controlled, according to the amount of lubricant applied to photoconductor drum 413, such that the amount of lubricant present after being applied to photoconductor drum 413 is always equal to or lower than a predetermined amount. In this case, control section 100 increases the conveyance speed of the developer so as to increase the amount of lubricant recycled from photoconductor drum 413 into developing device 412, in a case where the amount of lubricant applied to photoconductor drum 413 is large. Additionally, a lubricant recycle mechanism that recycles the lubricant present after being applied to photoconductor drum 413 may be provided, and a recycle operation of the lubricant recycle mechanism may be thus controlled such that the amount of lubricant present on photoconductor drum 413 is always equal to or less than the predetermined amount.

Furthermore, in the above embodiment, a description has been given with an example in which, in the moving direction (rotating direction) of intermediate transfer belt 421, image forming units 41Y, 41M, 41C, and 41K that form the colored toner images (downstream side image forming units) are arranged on the downstream side relative to image forming unit 41W that forms the spot color toner image (upstream side image forming unit); however, the present invention is not limited to this. For example, in the moving direction (rotating direction) of intermediate transfer belt 421, image forming units 41Y, 41M, 41C, and 41K (upstream side image forming units in this case) that form the colored toner images (corresponding to the "first toner image" of the present invention) may be arranged on the upstream side relative to image forming unit 41W (downstream side image forming unit) that forms the spot color toner image (corresponding to the "second toner image" of the present invention). Note that, photoconductor drums 413 included in image forming units 41Y, 41M, 41C and 41K correspond to the "first image carrier" of the present invention. Meanwhile, photoconductor drum 413 included in image forming unit 41W corresponds to the "second image carrier" of the present invention.

In this case, transferability (transfer rate) of the spot color toner image which overlaps with the colored toner images on intermediate transfer belt 421 (i.e., the spot color toner image which is transferred onto the colored toner images) decreases. As a result, in image forming unit 41W, the amount of spot color toner, that is, external additive reaching coating brush roller 416B without being transferred increases, and thus, the amount of lubricant scraped off from solid lubricant 416A by coating brush roller 416B, that is, the lubricant consumption increases.

Note that, transferability (transfer rate) of the spot color toner image which does not overlap with the colored toner images on intermediate transfer belt 421 (i.e., the spot color toner image which is not transferred onto the colored toner images) does not decrease. As a result, in image forming unit 41W, the amount of spot color toner, that is, external additive reaching coating brush roller 416B does not increase, and thus, the amount of lubricant scraped off by coating brush roller 416B, that is, the lubricant consumption does not increase.

Thus, for the purpose of suppressing an increase in the lubricant consumption, control section 100 controls the supply amount of lubricant to photoconductor drum 413 of image forming unit 41W in accordance with the overlap amount between the colored toner images transferred from photoconductor drums 413 of image forming units 41Y, 41M, 41C and 41K to intermediate transfer belt 421 and the spot color toner image transferred from photoconductor drum 413 of image forming unit 41W to intermediate transfer belt 421. More specifically, control section 100 sets the supply amount of lubricant by setting the rotational speed of coating brush roller 416B (the number of rotations per unit time) in accordance with the overlap amount W between the colored toner images and the spot color toner image. In a case where overlap amount W is represented by A [%], control section 100 sets the rotational speed of coating brush roller 416B included in image forming unit 41W, using the following Equation 5.

$$\text{Rotational speed of coating brush roller } \mathbf{416}\text{B} = \text{rotational speed of coating brush roller } \mathbf{416}\text{B (default value)} \times (1 - 0.01 \times a) \quad \text{(Equation 5)}$$

That is, taking into account that external additive reaching coating brush roller 416B without being transferred increases and the amount of lubricant scraped off by coating brush roller 416B, that is, the lubricant consumption increases as overlap amount W increases, the rotational speed of coating brush roller 416B is made smaller than the default value in advance to reduce the supply amount (consumption) of the lubricant solely resulting from the rotation of coating brush roller 416B. Thus, it is possible to suppress an increase in lubricant consumption in image forming unit 41W.

Figure 6:
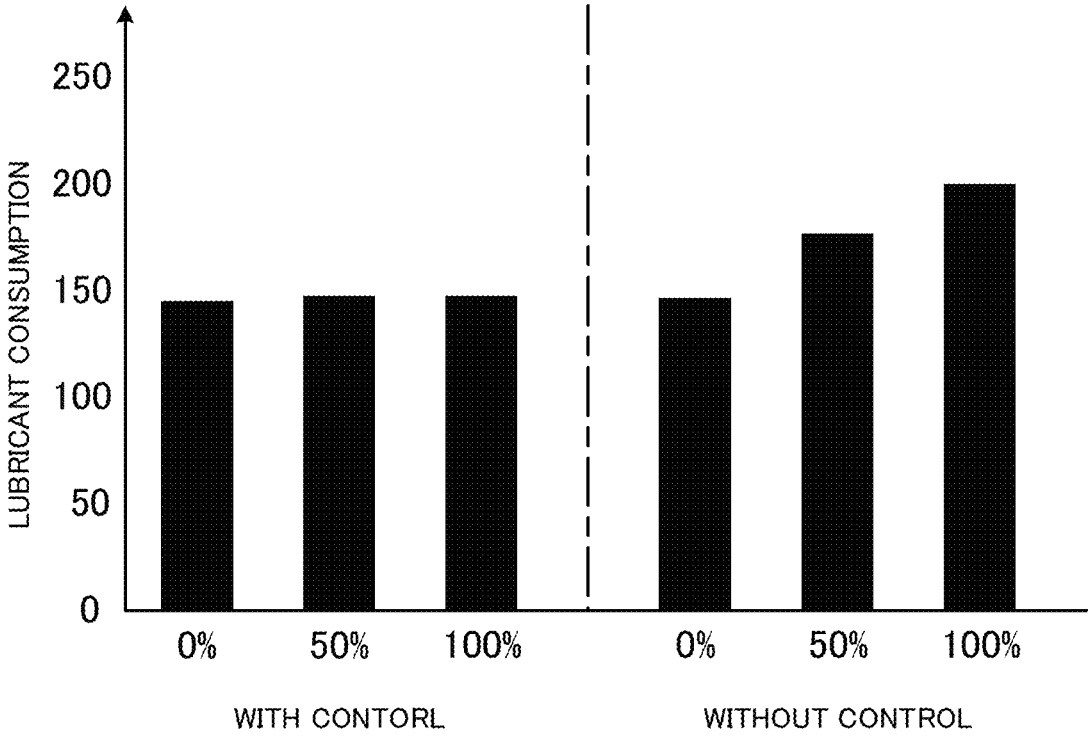
FIG. 6 illustrates a relationship between the overlap amount between the spot color toner image and the colored toner images, and lubricant consumption.

FIG. 6 illustrates a relationship between the overlap amount between the spot color toner image and the colored toner images, and lubricant consumption in image forming unit 41W. Specifically, FIG. 6 illustrates an experimental result of how the lubricant consumption varies between when the lubricant supply control operation is executed (with control) and when the lubricant supply control operation is not executed (without control), in a case where two type charts, namely, a spot color chart and a colored chart are prepared to form an image, and the overlap amounts between the spot color toner image and the colored toner images are set to 0 [%], 50 [%], and 100 [%], respectively.

As illustrated in FIG. 6, when the lubricant supply control operation is not executed, the lubricant consumption may increase as the overlap amount between the spot color toner image and the colored toner images increases (approaches 100%), and thus, the life of the cleaning member (drum cleaning blade) may decrease. On the other hand, when the lubricant feed control operation is executed, the lubricant consumption is stable and does not increase as the overlap amount between the spot toner image and the colored toner images increases. Thus, it is possible to suppress an increase in lubricant consumption in image forming unit 41W.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus, comprising:

a transfer body;

a first image carrier on which a first toner image using toner of a first color is formed;

a second image carrier on which a second toner image using toner of a second color is formed, the second image carrier being provided on a downstream side relative to the first image carrier in a moving direction of the transfer body;

a lubricant supplier that supplies a lubricant to the second image carrier; and a hardware processor that controls a supply amount of the lubricant in accordance with an overlap amount between the first toner image and the second toner image which are transferred from the first image carrier and the second image carrier to the transfer body.

2. The image forming apparatus according to claim 1, wherein:

the first color is a spot color;

the second color is a colored color; and the hardware processor reduces the supply amount of the lubricant as the overlap amount decreases.

3. The image forming apparatus according to claim 2, wherein a plurality of the second image carriers are provided.

4. The image forming apparatus according to claim 1, wherein:

the first color is a spot color;

the second color is a colored color; and the hardware processor reduces the supply amount of the lubricant as the overlap amount increases.

5. The image forming apparatus according to claim 1, wherein:

the lubricant supplier includes a rotation brush which rotates in contact with the lubricant and a surface of the second image carrier to supply the lubricant to the surface of the second image carrier; and the hardware processor controls the supply amount of the lubricant by controlling a rotational speed of the rotation brush.

6. The image forming apparatus to claim 1, wherein:

the lubricant supplier includes a rotation brush which rotates in contact with the lubricant and a surface of the second image carrier to supply the lubricant to the surface of the second image carrier; and the hardware processor controls the supply amount of the lubricant by controlling a pressing force of the lubricant against the rotation brush.

7. A lubricant supply control method for an image forming apparatus including: a transfer body; a first image carrier on which a first toner image using toner of a first color is formed; and a second image carrier on which a second toner image using toner of a second color is formed, the second image carrier being provided on a downstream side relative to the first image carrier in a moving direction of the transfer body, the lubricant supply control method comprising:

controlling a supply amount of a lubricant to the second image carrier in accordance with an overlap amount between the first toner image and the second toner image which are transferred from the first image carrier and the second image carrier to the transfer body.

* * * * *